US008789777B2

(12) United States Patent
Schenk

(10) Patent No.: US 8,789,777 B2
(45) Date of Patent: Jul. 29, 2014

(54) CONCRETE SEPARATING DEVICE

(76) Inventor: Koos Jacobus Schenk, Oss (NL)

( * ) Notice: Subject to any disclaimer, the term of this patent is extended or adjusted under 35 U.S.C. 154(b) by 0 days.

(21) Appl. No.: 13/696,550

(22) PCT Filed: May 9, 2011

(86) PCT No.: PCT/NL2011/050314
§ 371 (c)(1),
(2), (4) Date: Nov. 26, 2012

(87) PCT Pub. No.: WO2011/142663
PCT Pub. Date: Nov. 17, 2011

(65) Prior Publication Data

US 2013/0092769 A1 Apr. 18, 2013

(30) Foreign Application Priority Data

May 11, 2010 (NL) ..... 2004700

(51) Int. Cl.
*B02C 1/00* (2006.01)
*B02C 18/02* (2006.01)

(52) U.S. Cl.
USPC ..... 241/30; 241/264; 241/265; 241/266; 241/267; 241/268; 241/269

(58) Field of Classification Search
USPC ..... 241/30, 264–269
See application file for complete search history.

(56) References Cited

U.S. PATENT DOCUMENTS 4,406,416 A * 9/1983 Tateishi ..... 241/269
5,172,869 A * 12/1992 Kitsukawa et al. ..... 241/264
5,397,069 A * 3/1995 Kitsukawa et al. ..... 241/267
5,660,337 A * 8/1997 Falbo et al. ..... 241/37
5,749,530 A * 5/1998 Nakayama et al. ..... 241/27
7,614,573 B1 * 11/2009 Jean ..... 241/264
2004/0050987 A1 * 3/2004 Rossi, Jr. ..... 241/101.77
2006/0097095 A1 5/2006 Boast

FOREIGN PATENT DOCUMENTS

DE 1085401 B * 7/1960
DE 1085401 B * 7/1960
DE 8913077 U1 * 11/1989 ..... B02C 1/04
DE 8913077 U1 * 11/1989 ..... B02C 1/04
DE 8913077 12/1989
DE 4121797 A1 * 2/1991 ..... B02C 23/38
DE 4121797 A1 * 2/1991 ..... B02C 23/38
DE 4121797 A1 1/1993
EP 0442309 A2 8/1991
FR 2832650 A1 5/2003

(Continued)

*Primary Examiner* — Shelley Self
*Assistant Examiner* — Onekki Jolly
(74) *Attorney, Agent, or Firm* — Roberts & Roberts, LLP

(57) ABSTRACT

The present invention relates to a separating device for crushing concrete. The separating device comprises at least two crusher members which, optionally in co-action with bounding elements situated adjacently of the at least two crusher members, define at their upper outer ends an inlet opening for concrete to be crushed and at their lower outer ends an outlet opening for crushed concrete or at least concrete fractions. The separating device further comprises a drive device adapted to move repetitively at least a part of one of the two crusher members in the direction away from and toward the other crusher member. Outlet restriction means are provided under the outlet opening to limit an outflow of crushed concrete and/or concrete fractions. The invention further relates to a method for crushing and separating a composite material, in particular concrete, into original components.

15 Claims, 7 Drawing Sheets

(56) References Cited

FOREIGN PATENT DOCUMENTS

| | | | | |
|---|---|---|---|---|
| GB | 2343472 | A | 5/2000 | |
| GB | WO 2004/014558 | A1 * | 7/2003 | ..... B02C 1/02 |
| GB | WO 2004/014558 | A1 * | 7/2003 | ..... B02C 1/02 |
| JP | 6015188 | A | 1/1994 | |
| JP | 06015188 | A * | 1/1994 | ..... B01C 1/00 |
| WO | 0041812 | A1 | 7/2000 | |
| WO | 2004/014558 | | 2/2004 | |

* cited by examiner

CONCRETE SEPARATING DEVICE

According to a first aspect the present invention relates to a separating device. Concrete fractions are understood to mean both concrete components, crushed concrete and a mixture thereof. The invention can also be applied for composite materials similar to concrete of relatively large and relatively small components.

A known device for crushing concrete has two crushing jaws in the form of plates, which extend converging relative to each other as seen in downward direction from the top and which are bounded on their sides by static vertical side walls. The crushing jaws and the side walls together form a hopper with a relatively large inlet opening on the top side for receiving concrete to be crushed. The upper ends of the crushing jaws are situated at a mutual distance large enough to receive chunks of concrete to be crushed. The concrete to be crushed is tipped here into the inlet opening by a conveyor belt. A drive device in the form of an eccentric for a jaw moves the upper outer end of one of the crushing jaws repetitively away from and toward the other, static, crushing jaw. The concrete is thus always pressed through the jaws moving toward each other, after which the crushing jaws move apart to allow the concrete to drop into the hopper between the crushing jaws. The one crushing jaw is then moved toward the other again in order to exert pressure on the concrete situated between the jaws. The movement of the jaw or jaws is intended to crush the concrete to be crushed with the highest possible output and press it through the outlet. The concrete is (further) crushed or ground due to the stresses occurring here between and in the pieces of concrete to be crushed. The smaller the fractions of the (partially) crushed concrete, the further the fractions drop in the direction of the outlet opening, wherein the crushing jaws define an outlet opening in the form of a gap. The outlet opening is adapted to the dimensions of a fraction to be produced and is for instance about 40 mm. The distance between the crushing jaws on their underside, with the desired size of the crushed pieces of concrete, also determines the flow rate, together with the frequency of the reciprocally moving crushing jaw and the composition of the concrete to be crushed.

A drawback of the known device is the low-value output thereof, i.e. small pieces of randomly crushed concrete (mixture), because the original components of the concrete (mixture), unhydrated cement, cement stone, sand, gravel are not separated from each other.

The present invention therefore aims to provide a separating device for concrete, with which the component parts of the concrete, such as unhydrated cement, cement stone, sand and gravel, can be better separated from each other so that a higher-value output is realized. This object is made possible by the present invention in that outlet restriction means are provided under the outlet opening to limit an outflow of crushed concrete and/or concrete fractions. This means that the mutual distance between the crusher members themselves is not the (only) restriction, but that an additional restriction is provided below the outer ends. Such a measure moreover provides the option of increasing the mutual distance between the crusher members, while this need not have any adverse effect on the fineness of the crushed concrete. The effect which hereby occurs is discussed in the following paragraph.

When the outlet opening of a separating device for concrete is relatively small, as is the case in the crushing devices known heretofore, concrete is often crushed "through the gravel" when two gravel pebbles are situated adjacently of each other directly between the crusher members close to the outlet opening, and are pressed further toward each other by the jaws. The force exerted by the crusher members is exerted on a relatively small amount of matter, whereby the contact surfaces of the matter are exposed to relatively high pressure, whereby random break lines appear through the concrete. When there is more space between the crusher members, the pressure on the matter is reduced and the pebbles moreover have sufficient space to move upward or downward between the other rubble. A consequence hereof is that the pebbles will break less easily and, as a result of the force exerted on the concrete and the relative movement of the gravel pebbles, sand and cement are pressed and scoured from the gravel pebbles. This because cement stone has a lower strength than a gravel pebble and will therefore collapse first. In the case where there is a greater distance between the crusher members, outlet restriction means, which slow down throughflow, are provided in order to hold the partially crushed/separated material between the jaws for a relatively long time. In contrast to the known crushing device, the concrete is thus not so much broken into pieces but much rather broken down into component parts of the concrete. This has the advantage that the output of the crushing process is of higher quality. This has environmental advantages, the utility of the individual elements increases, and thereby also their economic value.

A separating device, particularly for separating concrete into original components, is distinguished from crushing devices in that the separating device can be adjusted, for instance by means of adjusting means, to exert a maximum force on matter between the crusher members which is considerably smaller than that in crushing devices. Crushing devices have the purpose of breaking matter into smaller elements. It is of no importance here where breaking occurs. In separating devices of the type according to the invention it is precisely this crushing of determined components, such as for instance gravel, which is prevented. Known crushing devices are therefore not suitable as separating device of the type according to the present invention.

German patent application DE 4121797 A1 describes a device for reducing granular bulk material with two crushing devices connected in series, i.e. two crushing plates which are movable toward each other and away from each other, and a crushing roller. This document does not describe the separation into (original) components of a composite material such as concrete. Nor is an outlet restriction provided under the outlet opening between the crushing roller and the plate.

German patent application DE 10 85 401 B also describes a crushing jaw device. The outlet opening of this device is situated between a closing plate and a crushing plate. No outlet restriction is provided after the outlet opening.

The American patent document U.S. Pat. No. 4,406,416 describes a jaw crusher for crushing stones or rock. The separation of composite material is not described in this document either. The described device is not suitable for this purpose, precisely because according to the aimed result of the invention stones must be prevented from breaking. The screw conveyor under the outlet opening serves to discharge crushed rock. Because material running out of the outlet opening is collected and further transported in simple manner by the relatively large screw conveyor, and the cross-sectional area thereof is much greater than that of the output flow, the screw conveyor cannot be deemed an outlet restriction.

French patent application FR 2 832 650 A1 describes a processing device, particularly for stone, with which sharp protrusions are broken off stone in order to obtain smaller stones with a less jagged surface. This crushing device is not suitable either for preventing breakage of stones, and is thus not a separating device.

British patent application GB 2 343 472 describes a mobile recycling apparatus which, due to its dimensions alone, would not be suitable for crushing concrete. This apparatus has no outlet restriction means.

In a preferred embodiment according to the present invention the outlet restriction means comprise a rotatable drum provided under the outlet opening, wherein the mutual distance between the respective crusher members on the one hand and the drum on the other limits the outflow of crushed concrete. During crushing of the concrete by the separating device the rotatable drum can rotate in one fixed direction or in a chosen direction. The axis of the drum extends parallel here to the outlet opening formed between the lower outer ends of the crusher members and is preferably situated directly below the central axis of the outlet opening, but may also be in slightly offset orientation relative to this axis of the outlet opening. The surface of the drum can be smooth, although a relief can also be provided in the drum surface. The mutual distance between a crusher member and the drum can differ from the mutual distance between the other crusher member and the drum, which can for instance be zero.

In an alternative embodiment according to the present invention the outlet restriction means comprise a vibrating plate provided under the outlet opening at a slight incline relative to the horizontal, wherein the mutual distance between the respective crusher members on the one hand and the vibrating plate on the other limits the outflow. In the case of a slightly inclining upper surface of the vibrating plate, concrete which has been crushed to sufficient extent moves downward along the vibrating plate as it vibrates and beyond the crusher member which is located above the vibrating plate on that side of the vibrating plate and which forms an outlet restriction together with the vibrating plate.

It is preferred here that the vibrating plate forms an angle of inclination relative to the horizontal, this angle of inclination lying in the range of 1 to 20 degrees, more preferably between 1 and 15 degrees. The steeper the angle of inclination, the quicker sufficiently crushed concrete is discharged. When adjusting means are provided for the purpose of adjusting the angle of inclination, the operation of the separating device can be influenced by setting a larger or smaller angle of inclination.

The outlet restriction means can also comprise a belt conveyor provided substantially horizontally under the outlet opening, wherein the mutual distance between a crusher member on the one hand and the belt conveyor on the other forms an outlet restriction. A belt conveyor, which can otherwise have a surface assembled from (metal) elements, can transport the sufficiently crushed concrete directly to a subsequent station. In the above stated embodiments a conveyor can be provided under the restriction means.

In a preferred embodiment according to the present invention the crusher members with respective crushing surfaces are arranged converging relative to each other as seen from top to bottom. An upward force is thus generated which supports the present invention in slowing the throughflow through the crusher members. The provided funnel shape contributes toward slowing of the throughflow of the matter to be crushed and partially crushed and separated matter in the device.

Irrespective of the nature of the restricting means, the mutual distance between the respective crusher member and the outlet restriction means will be smaller than the mutual distance of the outlet opening defined by the lower outer ends of the crusher members. The mutual distance between the crusher members at the outlet opening preferably amounts to at least 100 mm. Without the outlet restriction means concrete with a diameter of less than 100 mm could leave the separating device unimpeded. For a good operation of the separating device according to the present invention, wherein the outlet opening is preferably at least 150 mm, and still more preferably at least 200 mm, a better separation of the concrete into the component parts is however conversely realized by the mutual distance between the crusher members, whereby a better sorting of the output of the separating device can be realized. When a force is realized by the crusher members such that the pressure on the contact surfaces of the crushed concrete is less than the pressure at which gravel in the concrete can break, the gravel is thus scoured clean by the surfaces of the gravel with cement stone rubbing against each other.

When the outlet restriction means form a finer filter than the outlet opening, the outlet restriction means form an obstruction to the discharge speed of at least partially crushed and separated matter, whereby the outlet opening becomes partially blocked, with the effect that the matter remains between the crusher members longer. The term filter may be interpreted very broadly and does in effect mean obstruction of a good throughflow. The cross-sectional area of the flow of matter at the outflow opening is thus greater than the cross-sectional area of the flow of matter at the restriction means.

It is further recommended that the mutual distance of the crusher members at the outlet opening is at least twice as great as the corresponding mutual distance between the outlet restriction means. The mutual distance of the crusher members at the outlet opening is preferably at least three times, more preferably five times greater than the corresponding mutual distance between the outlet restriction means. This has the effect of prolonging the residence time of matter between the crusher members.

The crusher members preferably comprise crushing plates. The crushing surfaces of the crushing plates can be slightly concave or convex. Crushing plates are simple but sturdy means by which a desired force can be exerted on the concrete to be crushed.

When at least one crusher member is provided with a relief on its surface facing toward the other crusher member, the at least one crusher member with the relief has a better grip on concrete to be crushed situated between the crusher members. This further reduces the risk of pebbles being broken during crushing of the concrete. Both crusher members can of course have such a relief.

A strong separating device can be realized when one of the crusher members is in static position. A static crusher member can be firmly secured and thereby has a relatively little chance of malfunction.

The static crusher member can comprise a surface movable in the height. Static is understood to mean more specifically that said crusher member substantially does not move toward and away from the other crusher member during the operation of the device. By moving the surface of the static crusher member upward and/or downward not only are forces exerted on the concrete situated between the crusher members in the clamping direction of the crusher members but also in a direction with a component at a right angle to this crushing direction. This increases the scouring and shearing forces, whereby the component parts in the concrete are more easily separated from each other during the crushing process. By moving the matter upward between the crusher members, for instance by means of the surface movable in the height, the feed through the device is limited, whereby a better separation of the components can be realized.

Furthermore or alternatively, spring means are preferably provided with which the static crusher member is spring-mounted in horizontal direction. When too great a force threatens to build up between for instance pebbles despite the greater mutual distance between the crusher members, the breaking of pebbles can be countered in that the static crusher member yields to some extent as a result of the spring means.

In a further preferred embodiment according to the present invention the static crusher member comprises several crusher member parts which lie one above another and are individually spring-mounted. This increases the effect intended by the spring means relative to a single, integrally spring-mounted crusher member.

It is recommended that sorting means are provided for sorting the components of the crushed concrete which have left the separating device via the outlet opening and the restriction means. The restriction means could in fact be deemed a first sorting device, although additional sorting means are intended here. The sorting means of the preferred embodiment are suitable for sorting concrete crushed by the separating device into different components such as unhydrated cement, cement stone, sand, gravel and/or chunks of concrete with a predefined coarseness, which must preferably be further crushed. Relatively large pieces of concrete can be filtered in order to be fed back to the inlet opening of the separating device.

Push back means 150 are preferably provided which drive matter situated between the crusher members in upstream direction, at least when the crusher members are not moving away from each other. In conventional crushing devices attempts are made to accelerate throughfeed by attempting to press the matter between the crusher members in the direction of the outlet opening while the crusher members move toward each other. In the separating device according to the present invention an opposite effect is however desired.

Jaw adjusting means are preferably further provided for adjusting the mutual distance and/or the orientation of one or both crusher members during operation and/or when not in operation. Adjusting means for adjusting the mutual distance out of operation will be used particularly when the quality of the input matter changes. Jaw adjusting means for adjusting the mutual distance during operation will be used particularly when the quality of the output must be adjusted, i.e. when it is determined that the original components of a concrete are insufficiently separated from each other or when (too much) breaking of gravel is ascertained in the output.

According to a second aspect, the present invention relates to a method for crushing and separating into original components of concrete, comprising tipping the concrete to be crushed into a supply opening of a separating device, crushing the concrete to be crushed using the separating device and discharging crushed concrete via transport means. According to the second aspect, the present invention has for its object to provide a method for separating concrete with which it is possible to crush and to separate the concrete into the component parts of the concrete better than with known crushing methods. According to the present invention this object is achieved in that a separating device according to the first aspect of the present invention is applied in the method. Separation of components is here understood to mean at least releasing the components from each other. The flow of matter can then optionally be divided into different flows with different components. The components are in fact separated from each other in that, at least in the case of concrete, gravel pebbles covered with cement stone are pressed against each other. This results in breakage in the weakest link, i.e. in the cement stone, in/between the unhydrated cement, in/between the sand and between these components and the gravel. When the force being exerted on the matter is sufficiently limited, the gravel itself cannot break.

In a preferred method according to the present invention the crushed concrete is transported at least by means of the outlet restriction means.

In a preferred embodiment of the method, pressure to be exerted by the crusher members on the matter between the crusher members is limited to less than 250 N/mm$^2$. Depending on the matter supplied, this force can be set differently, in the case of concrete with relatively less strong gravel to preferably 200 N/mm$^2$, or more preferably 150 N/mm$^2$. This pressure can be adjusted indirectly by adjusting the force the crusher members exert on the matter, the volume between the crusher members, the mutual distance between the crusher members, and so on. The pressure referred to here is the pressure which contact surfaces of cement stone, sand and gravel exert on each other's surfaces. This prevents, or at least impedes, breaking of gravel when concrete is crushed and separated into original components, which would decrease the value of the gravel.

In the method, matter leaving the separating device is preferably sorted. The different components can be divided by means of different sorting techniques, such as for instance wind separation, cyclones, screening and the like. Sorting preferably takes place according to type of material during sorting, although it is in addition (or precisely through sorting to type) also possible to sort according to size.

The present invention will be further elucidated hereinbelow on the basis of preferred embodiments of the present invention and with reference to the accompanying figures, in which.

Figure 1:
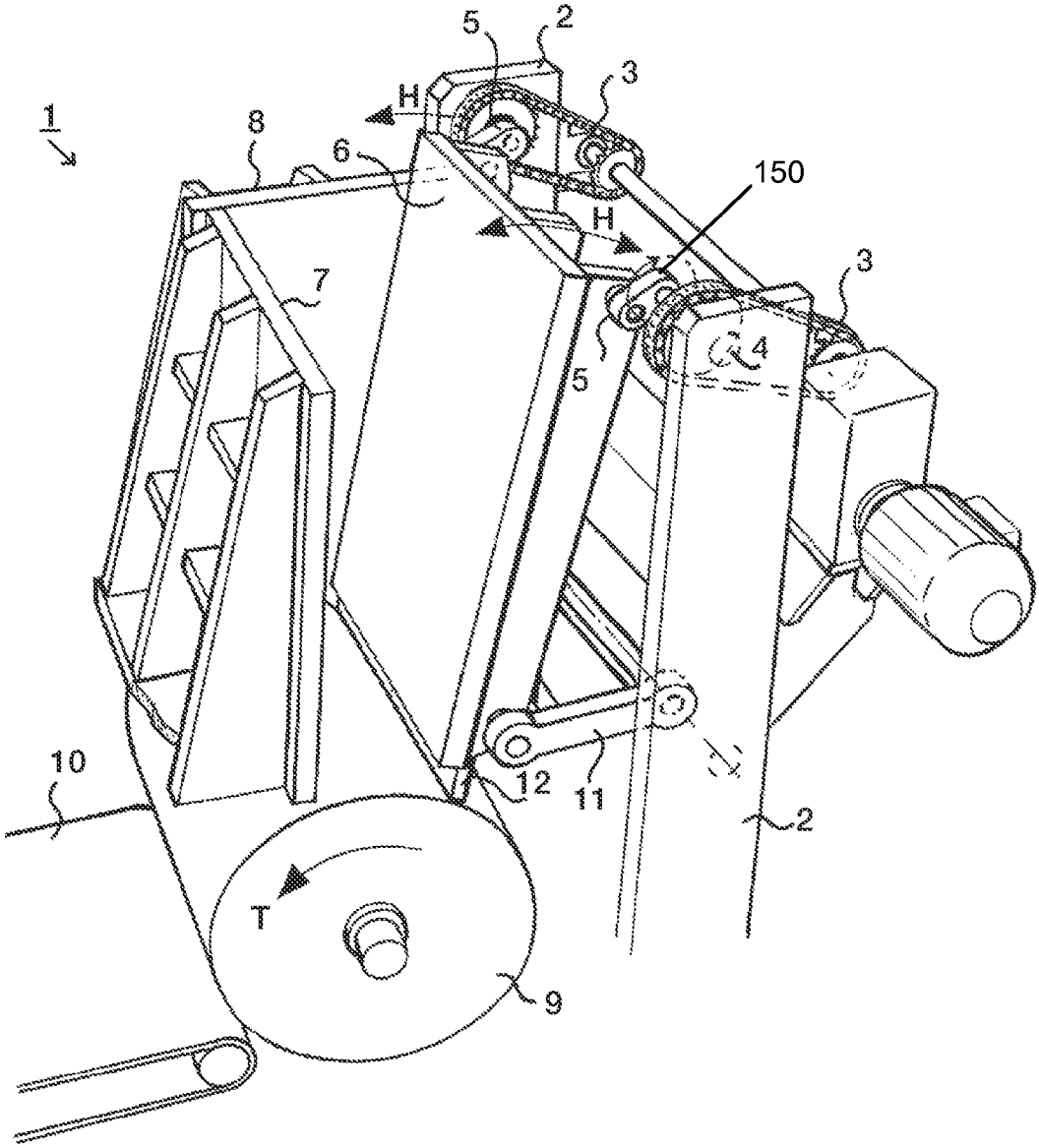
FIG. 1 is a schematic perspective side view of a first embodiment of a separating device according to the present invention.

FIG. 1 shows a perspective side view of a first embodiment of a separating device 1 for concrete according to the present invention. The separating device 1 comprises a frame 2 with inter alia uprights on which is mounted a drive 3 for rotation shafts 4 of an eccentric with cams 5. The cams 5 are connected to a movable crushing plate 6, opposite which a static crushing plate 7 is positioned. The crushing plates 6, 7 are flanked by side walls 8, only one of which is shown in FIG. 1 for the sake of clarity. Situated below the crushing plates are a rotatable drum 9 and a discharge belt 10. On the underside the crushing plate 6 is connected to a frame 2 by means of two pivot arms 11, only one of which is shown in FIG. 1. Situated at the bottom of the crushing plate 6 is a scraper 12. Arrows V and H indicate respectively the vertical and horizontal component of the movement of the crushing plate 6. Arrow T indicates the rotation direction of the drum 9. When the drum 9 rotates in the opposite direction, a scraper can be mounted on the static crushing plate 7.

Figure 2:
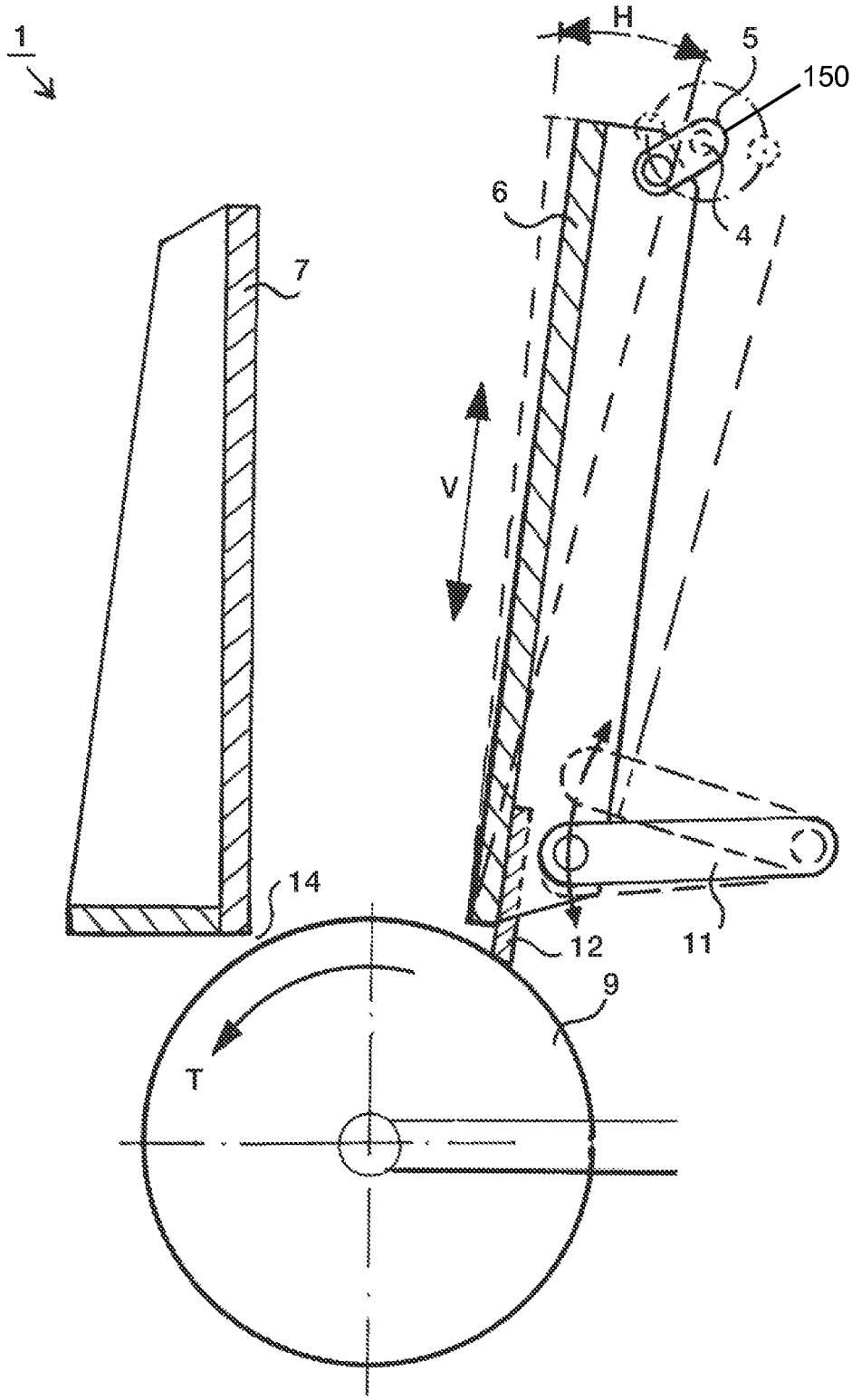
FIG. 2 is a schematic vertical cross-sectional view of a part of the separating device of FIG. 1.

FIG. 2 shows a schematic vertical cross-sectional view of a part of the separating device of FIG. 1, and the same reference numerals are therefore used for the same elements. The operation of the separating device 1 will be further elucidated below with reference to FIG. 7. In the separating device 1 the outlet restriction is formed by the crushing plate 7 on the one hand and the drum 9 on the other. The height of the gap 14 which is formed therebetween, and which can be adjusted by moving the drum away from the crushing plate 6 or toward the crushing plate 6, holds back concrete pieces of (excessively) large size.

Figure 3:
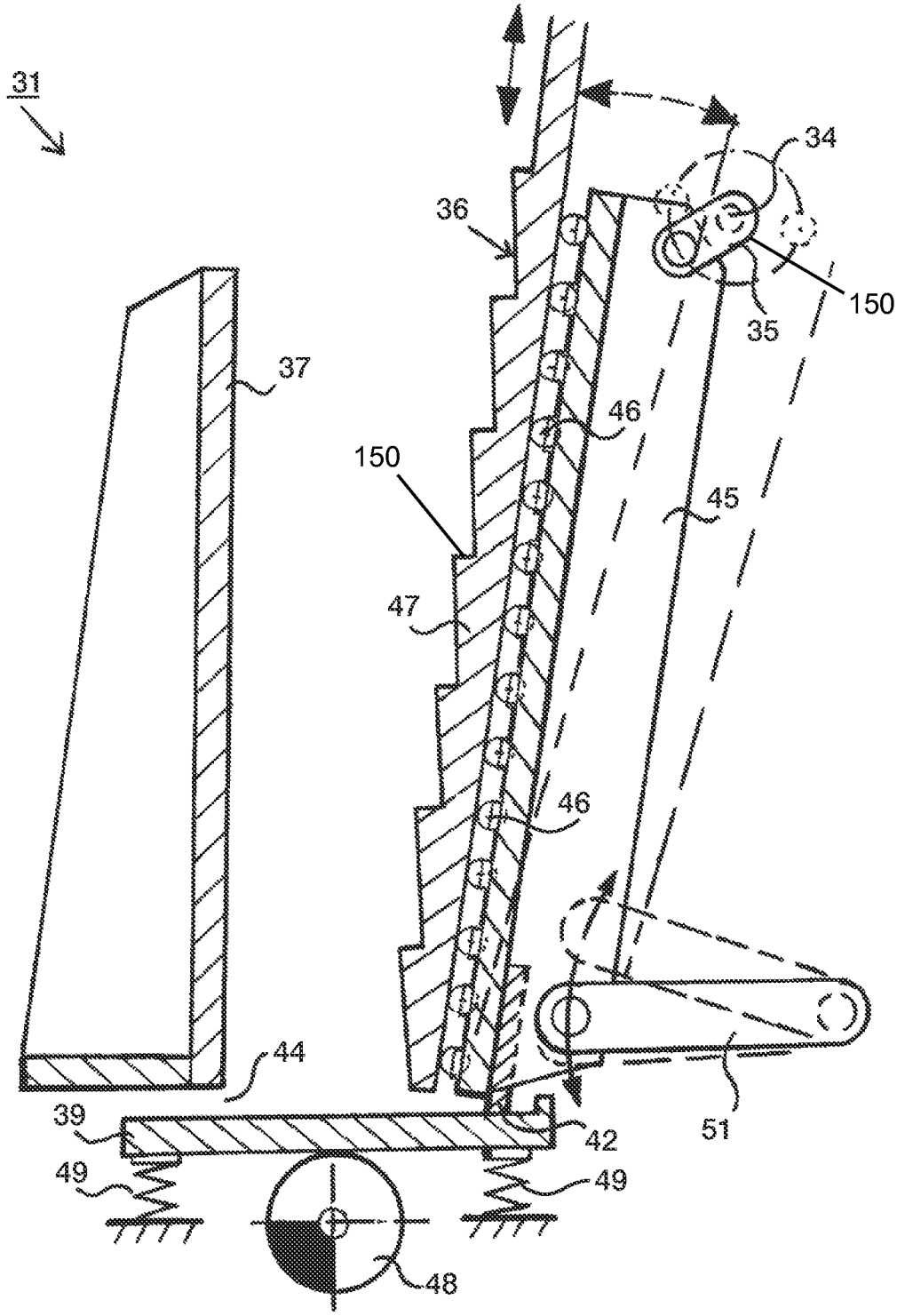
FIG. 3 is a schematic vertical cross-sectional view of an alternative embodiment of a separating device according to the present invention.

FIG. 3 shows a schematic vertical cross-sectional view through an alternative embodiment of a separating device 31 according to the present invention. The separating device 31, which can be mounted on a frame as shown in FIG. 1, likewise comprises an eccentric with cams 35 which are rotatable about a rotation shaft 34 and are connected to a compound movable crushing plate 36. The movable crushing plate 36 comprises a rear plate 45 and a toothed front plate 47, between which are provided roller guides 46. The front plate 47 is connected on its sides (not shown) to a cylinder drive which can move the front plate 47 vertically in reciprocal manner relative to the rear plate 45. Situated on the underside of the crushing plates 36, 37 is a vibrating plate 39, which supports in spring-mounted manner on either side on a ground surface by means of a spring device 49 and is driven vibratingly by the drum 48. Stopper 42 connects closely to the vibrating plate 39 which is driven by the vibrating motor 48. The opening 44 between the crushing plate 37 and the vibrating plate 39 forms the outlet restriction in this separating device 31. The vibrating plate 39 can alternatively be mounted directly on a vibrating plate, in which case the springs on the relevant side of the vibrating plate can be omitted.

Figure 4:
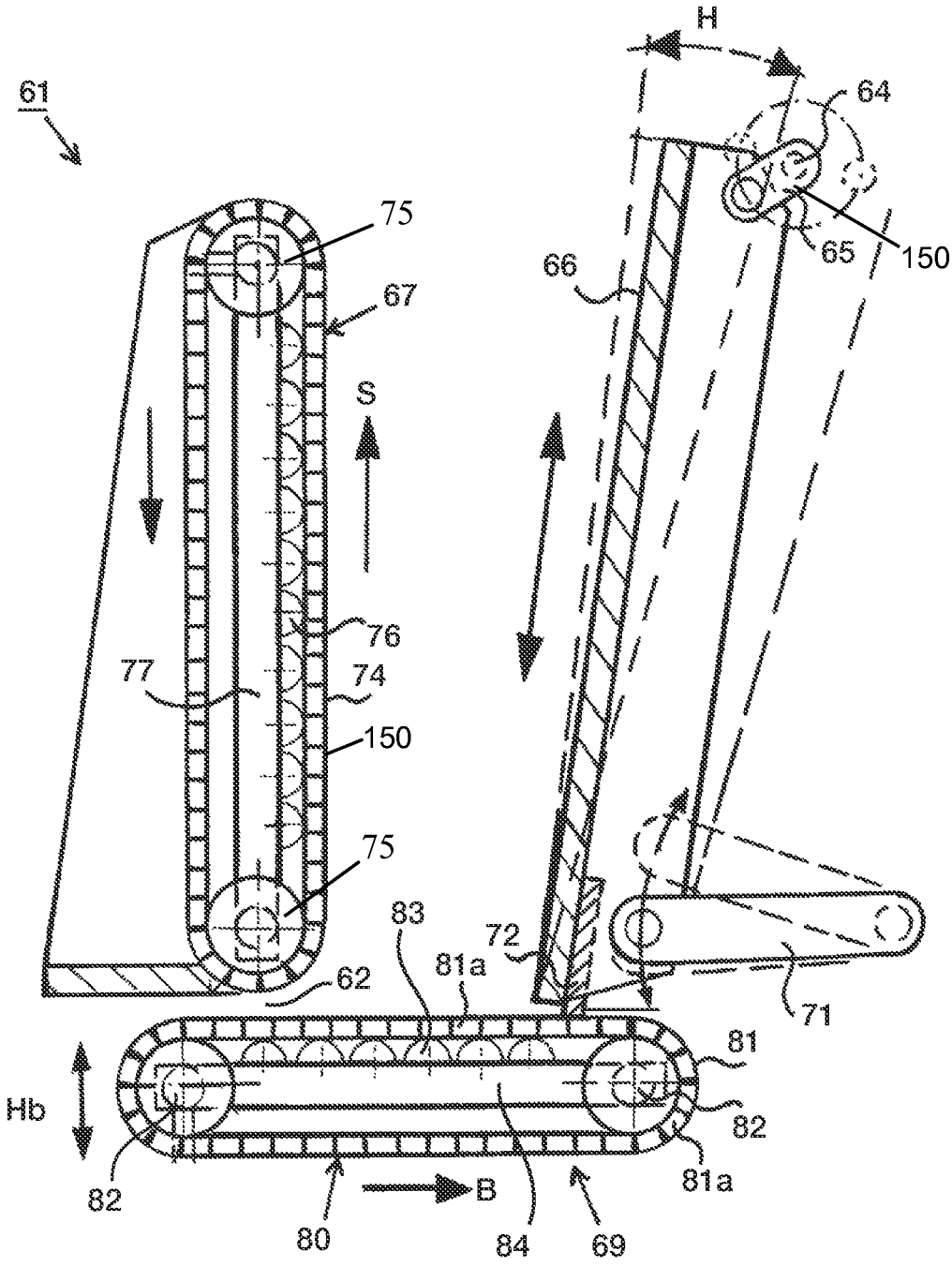
FIG. 4 is a schematic vertical cross-sectional view of yet another embodiment of a separating device according to the present invention.

FIG. 4 shows a schematic vertical longitudinal sectional view of an alternative separating device 61 according to the present invention. Via the cams 65 and the rotation shaft 64 the movable crushing plate 66 can be moved relative to the "static" crushing plate 67, which comprises an endless belt 74 which is trained round shafts 75 and supports against guide rollers 76 which are received in the support element 77. The endless belt 74 rotates in counter-clockwise direction as according to arrows S, whereby concrete present between the crushing plates 66, 67 is pulled upward to some extent by the endless belt 74. Situated below the crushing plates 66, 67 is a belt conveyor 80 with an endless belt 81 of mutually connected metal slats 81*a*, which is trained round shafts 82 and supports on the upper side on the carrier 84 via the guide rollers 83. The belt conveyor 80 displaces in counter-clockwise direction as according to arrow B and is height-adjustable as according to arrow Hb. The stopper 72 prevents concrete from being able to leave the separating device between the movable crushing plate 66 and the belt conveyor 80. The outlet restriction 62 of this device is situated between the endless belt 74 and the belt conveyor 80.

Figure 5A:
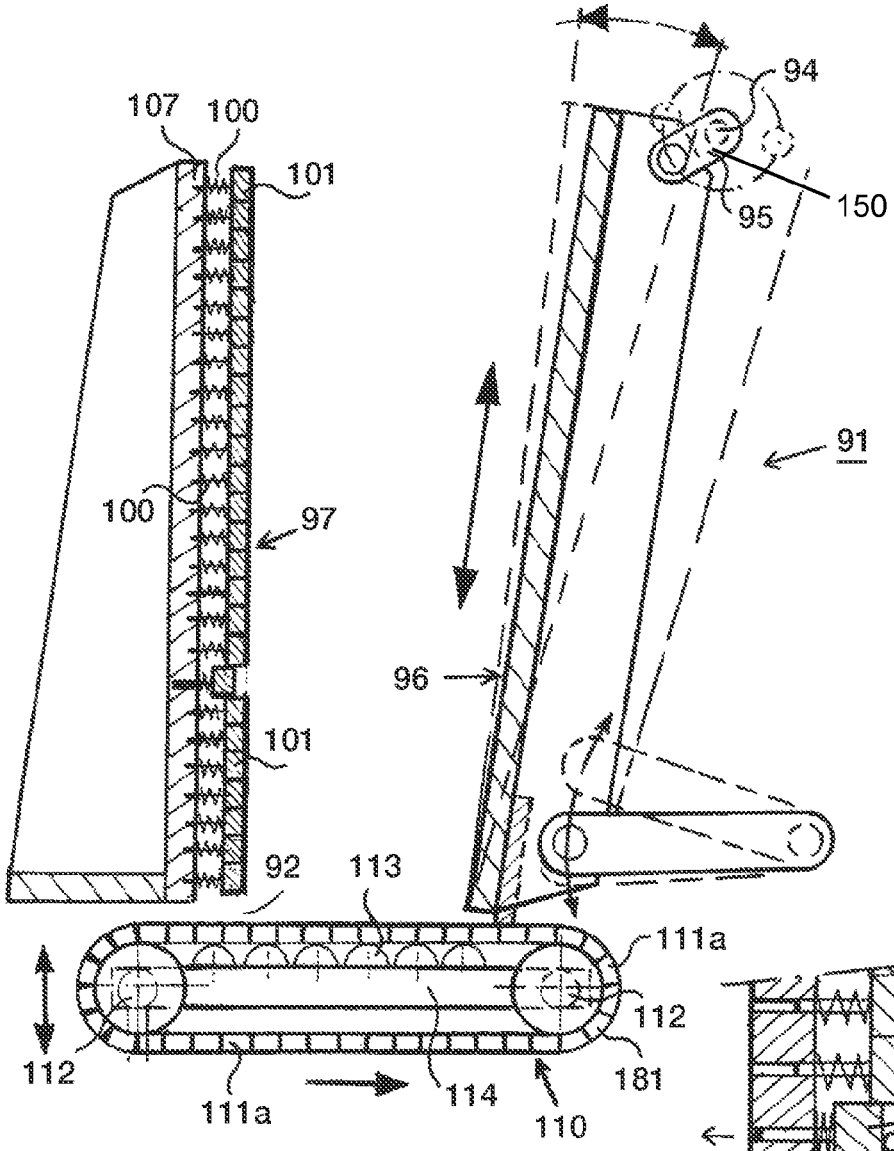
FIG. 5A is a schematic vertical cross-sectional view of a variant of the embodiment of FIG. 4.
Figure 5B:
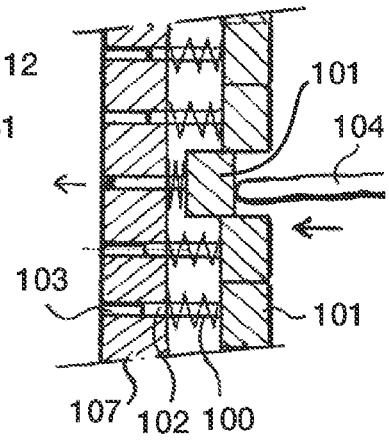
FIG. 5B is a detail view of the device of FIG. 5A.

FIG. 5A shows another alternative embodiment of a separating device 91 according to the present invention. The separating device 91 is based on the principle of the separating device 61 of FIG. 4, but has an alternative static crushing plate 97. Elements corresponding to similar elements of FIG. 4 are designated with a reference numeral which is thirty higher than the reference numeral for the similar element in FIG. 4. The static crushing plate 97 has a support element 107 in which horizontal slats 101 are received resiliently in the crushing plate 97 by means of springs 100. This is elucidated in detail in FIG. 5B, showing a part of the support element 107 in which bores 103 are provided, in which are received pins 102 around which the springs 100 are arranged. A concrete element 104, which is shown schematically here, will press the slat 101 aside when the pressure on the concrete element 104 increases (too) greatly. The slats 101 could also be oriented horizontally instead of vertically, and alternative spring systems, such as for instance a hydraulic spring system, can be used for the springs.

Figure 6:
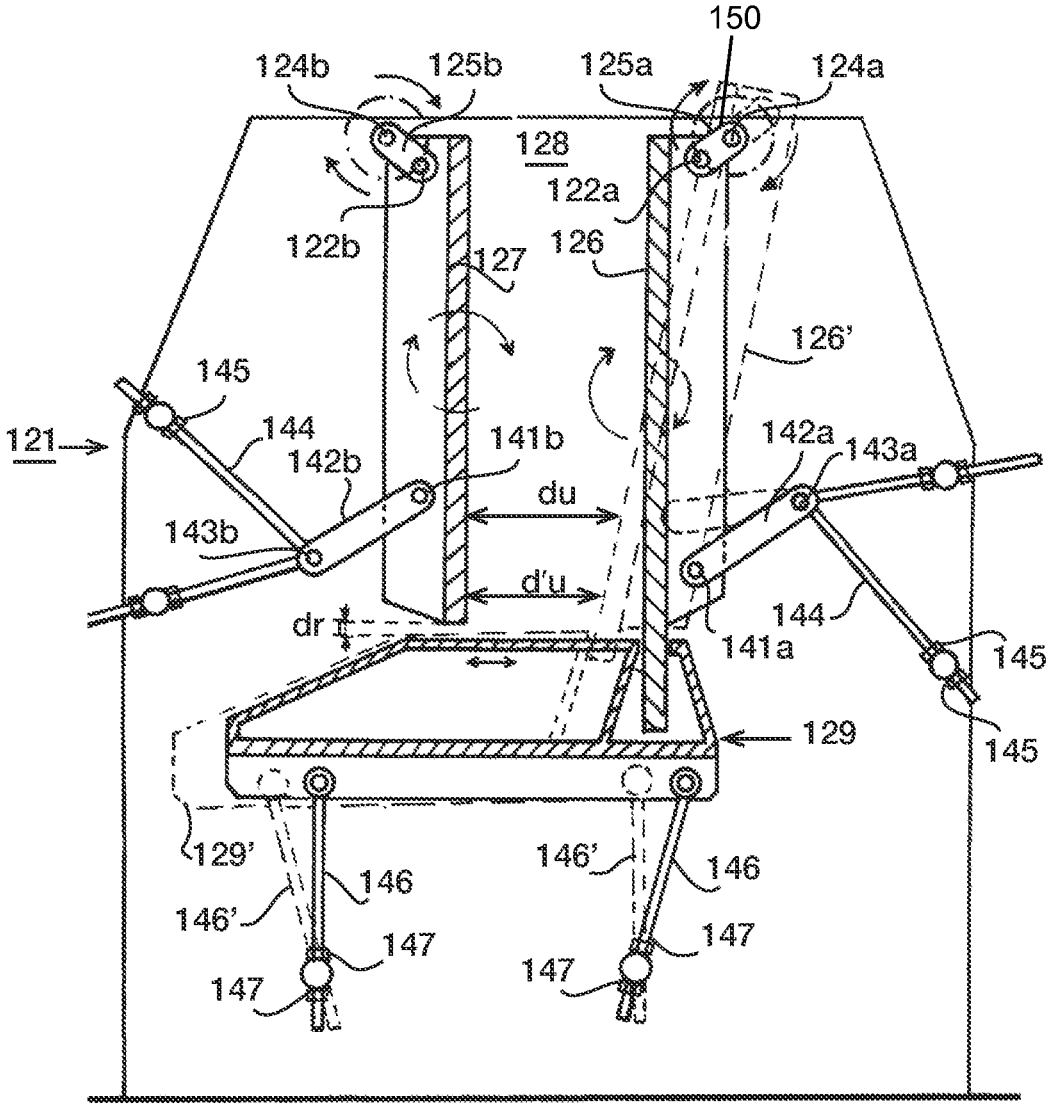
FIG. 6 is a schematic side view of another alternative embodiment of a separating device according to the present invention.

FIG. 6 shows a schematic side view of another alternative embodiment of a separating device 121 according to the present invention. Situated between two side walls, only one 128 of which is shown in FIG. 6, are two movable crushing plates 126, 127, which are moved in above described manner in that the cams 125*a*, 125*b* are rotated about their respective rotation shafts 124*a*, 124*b*, in the present case both in clockwise direction. The cams 125*a*, 125*b* are connected to the respective crushing plates 126, 127 via pivot shafts 122*a*, 122*b* and co-displace these plates in their movement. On the underside the crushing plates 126, 127 are suspended from respective rod systems via pivot shafts 141*a*, 141*b* and arms 142*a*, 142*b* and pivot shafts 143*a*, 143*b*. The rod systems consist in each case of two pairs of rods 144 (of which only the front rod of each pair is shown) with external screw thread, which are adjustable by means of adjusting nuts 145, whereby the starting position of the respective crushing plates 126, 127 can be adjusted. The positions of the respective pivot shafts 143*a*, 143*b* are set fixedly by the rods 144. When the crushing plates 126, 127 are thus driven by means of the cams 124*a*, 124*b*, the respective upper ends of the crushing plates 126, 127 co-displace with the associated cams 125*a*, 125*b*, the pivot shafts 143*a*, 143*b* remain at their set fixed position, and the position of the pivot shafts 141*a*, 141*b* and the parts of the crushing plates 126, 127 connected thereto is a resultant of the movement of the cams 125*a*, 125*b*. FIG. 6 shows with broken lines the position for the crushing plate 126 in an alternative position of the cam 122*a*. In this alternative position the relevant crushing plate is designated with 126'. The crushing plate 126 extends into a discharge table 129, which is also referred to as an obstipator because it prevents the through-flow of crushed material and which is positioned movably via the rods 146 provided with external screw thread and the adjusting nuts 147 under the outlet opening between the crushing plates 126, 127. The crushing plate 126 here co-displaces the discharge table 129 in its movement. In the alternative position of the crushing plate 126' indicated with broken lines the discharge table, designated in this position with 129', is situated in the position indicated with broken lines. In this exemplary embodiment the mutual distance between the lower ends of the crushing plates 126, 127 varies between a greatest distance $d_u$ of 25 cm and a smallest distance $d'_u$ of 35 cm. In this exemplary embodiment the mutual distance between the discharge table 129 and the left-hand crushing plate 127 varies between a shortest distance $d_r$ of 7 cm and a maximum distance $d'_r$ of 10 cm. In the shown embodiment the ratio of the mutual distance between the undersides of the crushing plates on the one hand and the vertical distance between the left-hand crushing plate 127 and the discharge table 129 is thus about 1:3.5. The position of the plates on the underside can be adjusted by means of the rods 144 and the adjusting nuts 145. The position of the discharge table 129 can be adjusted by means of the rods 146 and the adjusting nuts 147. During the operation of the separating device 121 the horizontal distance between the lower ends of the crushing plates 126, 127 will always be at least three times greater than the mutual distance between the left-hand crushing plate 127 and the discharge table 129. It will be apparent that for the sake of compactness in the drawing the separating device is only shown schematically and that, just as in the other figures, no actual dimensions may be inferred from the dimensions shown in this figure.

FIG. 6 shows the direction of movement of different components by means of arrows. The cam 125*a* rotates in clockwise direction and thus co-displaces the crushing plate 126, which performs a similar movement in clockwise direction. An important aspect supporting the operation of the separating device 121 is that during the movement in which the crushing plate 126 moves at the lower end in the direction of the crushing plate 127, the crushing plate 126 also makes an upward movement. Matter present between the crushing plates 126, 127 during operation is here driven upward by the crushing plate 126. This in contrast to known crushing devices, wherein the rotation takes place in opposite direction precisely in order to press matter in the direction of the discharge table so as to thus exert as much force as possible on the matter in order to reduce this matter. When the crushing plate 126 then moves away again from the crushing plate 127, space is created on the underside into which matter present between the crushing plates 126 and 127 will drop. The matter is then driven upward again when the two crushing plates 126, 127 are moved toward each other. By ensuring that the force exerted on the matter between the crushing plates 126, 127 does not exceed a critical value, it is possible to ensure that components of a composite matter, such as concrete, are separated from each other without the risk of the components themselves being damaged. In the case of concrete this critical limit is about 100 $N/mm^2$. When the force exceeds this limit, there is an increased risk of gravel being broken between the plates, this being precisely what is not desired in the separating device.

Figure 7:
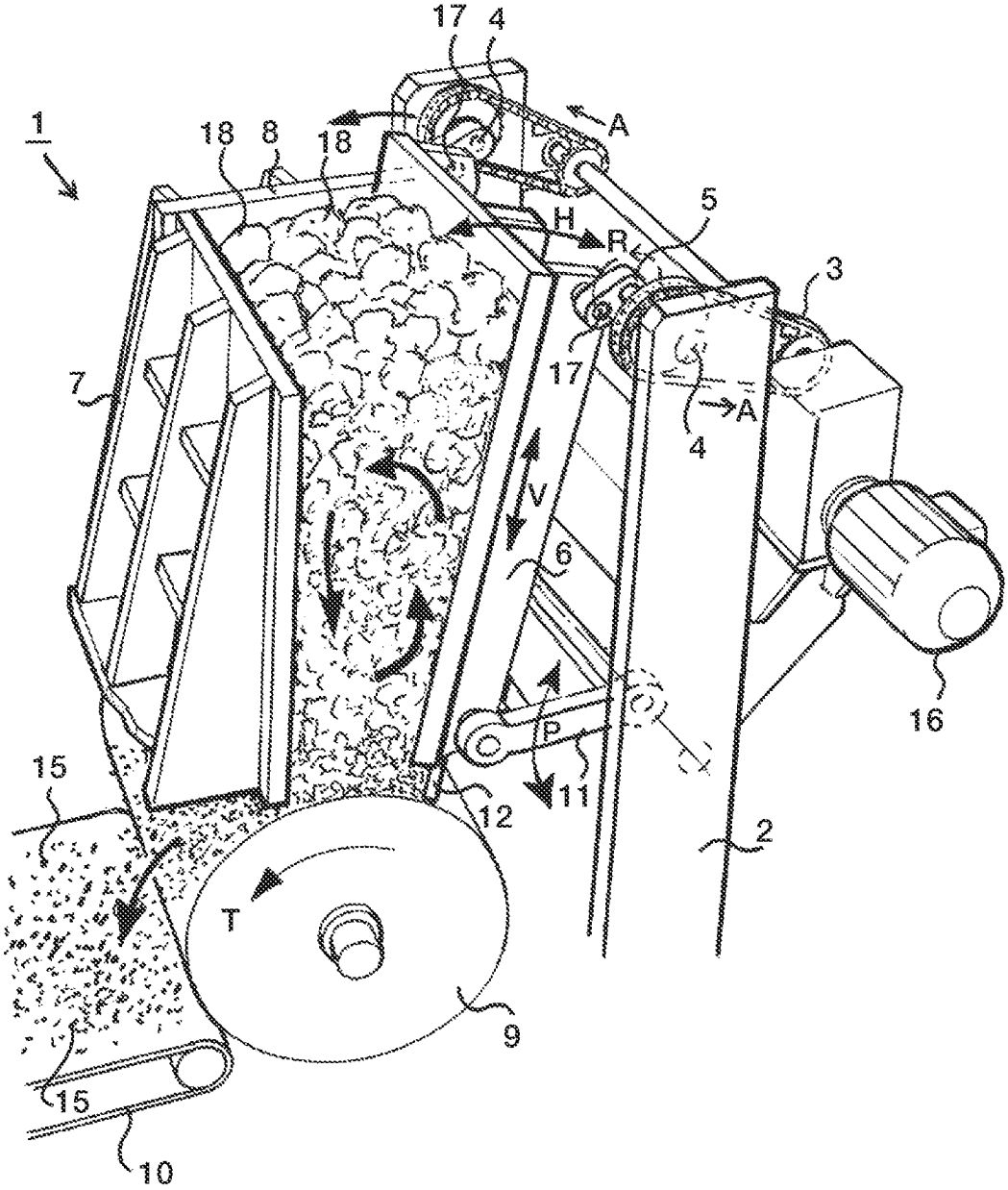
FIG. 7 is a perspective side view of the separating device of FIG. 1 in operation.

Finally, FIG. 7 shows the separating device 1 of FIG. 1 during operation, wherein chunks of concrete 18 are once again crushed between the crushing plates 6, 7 and then discharged in fractions. During operation concrete in the form of large chunks 18 is tipped via a belt conveyor (not shown) between the crushing plates 6, 7 and side walls 8 (of which only one is shown in FIG. 7). Motor 16 drives an eccentric formed by cam 5 with rotation shaft 4 and connecting shaft 17. The drive is shown schematically in this figure. A heavier drive can be used in practice to enable the rotation shaft 4 to be driven with sufficient force. Drive chains 8 move in the direction of arrows A and thereby rotate the rotation shaft 4 in counter-clockwise direction, see arrow R. The cam 5 rotates about the rotation shaft 4, whereby the cam 5 makes a circular movement as according to the direction of arrow R and thereby causes the connecting shafts 17 to make a circular movement about the rotation shaft 4. The connecting shafts 17 co-displace the movable crushing plate 6 in their movement, whereby at least the upper side of the crushing plate 6 makes a repetitive movement with a horizontal and a vertical component, designated with the arrows H, V. The pivot arm 11 is connected to the underside of the movable crushing plate 6 and moves reciprocally in the direction of arrow N so that the underside of the crushing plate 6 also makes a movement, albeit a movement damped to some extent relative to the upper side. The space between the crushing plates 6 and 7 is constantly increased and then decreased again by the horizontal component H in the movement of the crushing plate 6. When the space is increased, the concrete can drop between the crushing plates and is then compressed when the crushing plate 6 moves in the direction of the crushing plate 7. Owing to the thus generated pressure force the concrete will break into smaller pieces. This process is repeated, with the result that the concrete is crushed into increasingly smaller pieces and finally collected as fractions at the bottom between the crushing plates 6, 7. It will be apparent that relatively large pieces are still also present in the mixture at the bottom of the crushing plates 6, 7. The distance between the static crushing plate 7 and the drum 9 prevents (excessively) large chunks of concrete leaving the separating device via the drum 9 and forms as such an outlet restriction for concrete lying on the drum 9. The drum 9 rotates in the direction of arrow N and carries along the small fractions of concrete 15 in the direction of the discharge belt 10. Optionally connected behind the discharge belt 10 is a filter which filters the fractions, wherein different components can be separated and wherein relatively large fractions can be filtered out and then tipped back into the separating device 1. Scraper 12 prevents concrete being able to leave the separating device on the wrong side, so in opposite direction to the rotation of the drum 9. The drum 9 can have a magnetic surface whereby metal particles adhere to the surface of the drum 9 and so do not drop onto the discharge belt 10. When the surface of the drum 9 is demagnetized after passing the discharge belt 10, metal fractions can be collected under the drum 9. This is not described in further detail here. The scraper 12 scrapes the surface of the drum 9 clean before the surface of the drum 9 arrives again under the crushing plates 6, 7 for discharge of crushed concrete. The concrete between the crushing plates 6, 7 is also urged into movement in vertical direction by the movement of the movable crushing plate 6 in the vertical component (see arrow V).

Only a few embodiments of a separating device according to the present invention are shown in the figures and the above description. It will be apparent that many variants, which may or may not be self-evident to the skilled person, can be envisaged within the scope of protection of the present invention as defined by the following claims. The driving of the movable crushing plate can thus for instance be effected via hydraulic cylinders. Separate drives will then have to be provided for the horizontal and vertical component. The crushing plates can take different forms, such as for instance slightly concave or convex, and the rotation directions can be opposite to the directions indicated in the figures. The dimensions stated in the figure description must be deemed as examples. Depending on the type of concrete, the pebbles present therein can have different dimensions. The device and the method can further also be applied for separating into original components other materials which, just as concrete, comprise relatively large and relatively small components, such as mixed granulates or other mineral materials. No sorting means which sort the output of the separating device are described or shown in the description and the figures. These are however generally known means which are applied for at least partially separating components such as gravel, unhydrated cement, cement stone and sand. The rod systems with external screw thread can be replaced by other adjusting means, such as for instance cylinders. The mutual distances between the crushing plates of FIG. 6 are, just as many other variables in the figures, only chosen by way of example.

The invention claimed is:

1. A separating device for crushing and at least partially separating concrete into original components, comprising at least two at least substantially plate-like crusher members, which crusher members comprise upper outer ends which define an inlet opening for concrete to be crushed and at their lower outer ends an outlet opening for crushed concrete or at least concrete fractions, and a drive device operatively coupled to at least one of said crusher members, which drive device is adapted to move repetitively at least a part of one of the two crusher members in directions away from and toward the other crusher member, wherein an outlet restriction is provided under the outlet opening to limit an outflow of crushed concrete and/or concrete fractions, and wherein a push-back is provided which drives matter situated between the crusher members in an upstream direction, at least when the crusher members are not moving away from each other, said push-back being operatively coupled to at least one of the crusher members.

2. The separating device according to claim 1, wherein the outlet restriction comprises a rotatable drum provided under the outlet opening, wherein the mutual distance between the respective crusher members and the drum limits the outflow.

3. The separating device according to claim 1, wherein the outlet restriction comprises a vibrating plate provided under the outlet opening at a slight incline relative to the horizontal, wherein the mutual distance between the respective crusher members and the vibrating plate limits the outflow.

4. The separating device according to claim 3, wherein the vibrating plate forms an angle of inclination relative to the horizontal, this angle of inclination lying in the range of 1 to 20 degrees.

5. The separating device according to claim 1 wherein the mutual distance between the crusher members at the outlet opening amounts to at least 200 mm.

6. The separating device according to claim 1 wherein the outlet restriction forms a finer filter than the outlet opening.

7. The separating device according to claim 6, wherein the mutual distance of the crusher members at the outlet opening is at least twice as great as the corresponding mutual distance between the outlet restriction.

8. The separating device according to claim 1 wherein at least one of the at least two crusher members comprises a static crusher member which comprises a surface movable in height.

9. The separating device according to claim 1 wherein a filter is provided downstream from the outlet opening, for filtering crushed concrete which has left the separating device via the outlet opening.

10. The separating device according to claim 1 wherein crusher member adjusting is provided for adjusting the mutual distance and/or the orientation of one or both crusher members during operation and/or when not in operation.

11. The separating device of claim 1, wherein the upper outer ends of the crusher members define an inlet opening, together with side walls which are situated adjacently to the crusher members.

12. A method for crushing and separating into its original components of a composite material, comprising tipping the composite material to be crushed into a supply opening of a separating device; the separating device comprising at least two at least substantially plate-like crusher members, which crusher members comprise upper outer ends which define an inlet opening for composite material to be crushed and at their lower outer ends an outlet opening for crushed composite material or at least composite material fractions, and a drive device operatively coupled to at least one of said crusher members, which drive device is adapted to move repetitively at least a part of one of the two crusher members in directions away from and toward the other crusher member, wherein the pressure to be exerted by the crusher members on the composite material between the crusher members is limited to less than 250 $N/mm^2$, wherein an outlet restriction is provided under the outlet opening to limit an outflow of crushed composite material and/or composite material fractions; crushing the composite material to be crushed using the crusher members and discharging crushed composite material via a transport.

13. The method according to claim 12, the crushed composite material is transported at least using the outlet restriction.

14. The method according to claim 12 wherein the composite material comprises concrete.

15. The separating device of claim 12, wherein the upper outer ends of the crusher members define an inlet opening, together with side walls which are situated adjacently to the crusher members.

* * * * *